US005300009A

United States Patent [19]

Bittenbender

[11] Patent Number: 5,300,009

[45] Date of Patent: Apr. 5, 1994

[54] PAPERBOARD WASTE STRIPPING APPARATUS

[76] Inventor: Dan L. Bittenbender, 18560 Ridge La., Marengo, Ill. 60152

[21] Appl. No.: 76,762

[22] Filed: Jun. 15, 1993

[51] Int. Cl.[5] ..... B26F 3/02; B31B 49/00; B31B 3/74

[52] U.S. Cl. ..... 493/373; 493/342; 83/103; 83/117; 225/97; 225/99

[58] Field of Search ..... 493/82, 83, 342, 373; 225/93, 97, 98, 99; 83/103, 117

[56] References Cited

U.S. PATENT DOCUMENTS 687,905 12/1901 Seymour ..... 83/117
3,371,584 3/1968 Zernov ..... 493/373
3,964,655 6/1976 Kotaro ..... 225/97
5,087,237 2/1992 Nunley ..... 493/342

*Primary Examiner*—William E. Terrell
*Attorney, Agent, or Firm*—Richard W. Carpenter

[57] ABSTRACT

Apparatus for stripping waste material from a paperboard web in a die cutter or die cutting section of a press that includes an outer pin cylinder, carrying self cleaning stripper pin mechanisms, and an inner ejection cylinder mounted eccentrically within the outer pin cylinder by a mounting arrangement that has a longitudinally extending non-rotatable beam with a pair of trolleys mounted thereon that carry rollers engagable with the inner surface of the ejection cylinder to keep the ejection cylinder in a predetermined position at all times with respect to the pin cylinder for engagement with said stripper pin mechanisms.

20 Claims, 2 Drawing Sheets

PAPERBOARD WASTE STRIPPING APPARATUS

BACKGROUND OF THE INVENTION

1. Field of the Invention

This invention relates to cutting presses or die cutting sections of printing presses, and, more particularly, to apparatus for stripping waste material from a web of paperboard.

2. Description of the Background Art

A background art search directed to the subject matter of this invention conducted in the United States Patent and Trademark Office disclosed the following U.S. Pat. Nos.:

| | | | |
|---|---|---|---|
| 2,711,935 | 2,778,286 | 2,986,086 | 3,320,864 |
| 3,359,843 | 3,371,584 | 3,467,450 | 3,513,756 |
| 3,877,353 | 4,137,829 | 4,367,069 | 4,613,321 |
| 5,087,237 | | | |

None of the patents uncovered in the search discloses apparatus for stripping waste material from a paperboard web in a die cutter which apparatus includes an outer pin cylinder, carrying self cleaning stripper pin mechanisms, and an inner ejection cylinder, mounted eccentrically within the outer pin cylinder by a mounting arrangement that includes a longitudinally extending non-rotatable beam having a pair of trolleys fixedly mounted thereon and carrying rollers engagable with the inner surface of the ejection cylinder, to keep the ejection cylinder in a predetermined position at all times with respect to the pin cylinder for engagement with said stripper pin mechanisms.

SUMMARY OF THE INVENTION

It is a primary object of the invention to provide an improved apparatus for stripping waste material from a paperboard web on a die cutter or the die cutting section of a press.

Another object of the invention is the provision of a paperboard stripping apparatus that includes an arrangement wherein the stripper pin cylinder can be easily and quickly removed to greatly reduce the down time required to replace damaged pins.

Yet another object of the invention is to provide a novel mounting arrangement for a pin cylinder and an ejection cylinder that can be used to modify a press with a conventional pin and bar comb stripper by the substitution of a pin cylinder with self cleaning stripper pins that do not require bar combs to force the waste material off the ends of the stripper pins.

A more specific object of the invention is the provision of an improved mounting and positioning assembly for a pin cylinder and related ejection cylinder that includes a pair of roller carrying trolleys mounted on a fixed beam within the ejection cylinder and operable to engage the ejection cylinder and keep the ejection cylinder in a predetermined position relative to the pin cylinder.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
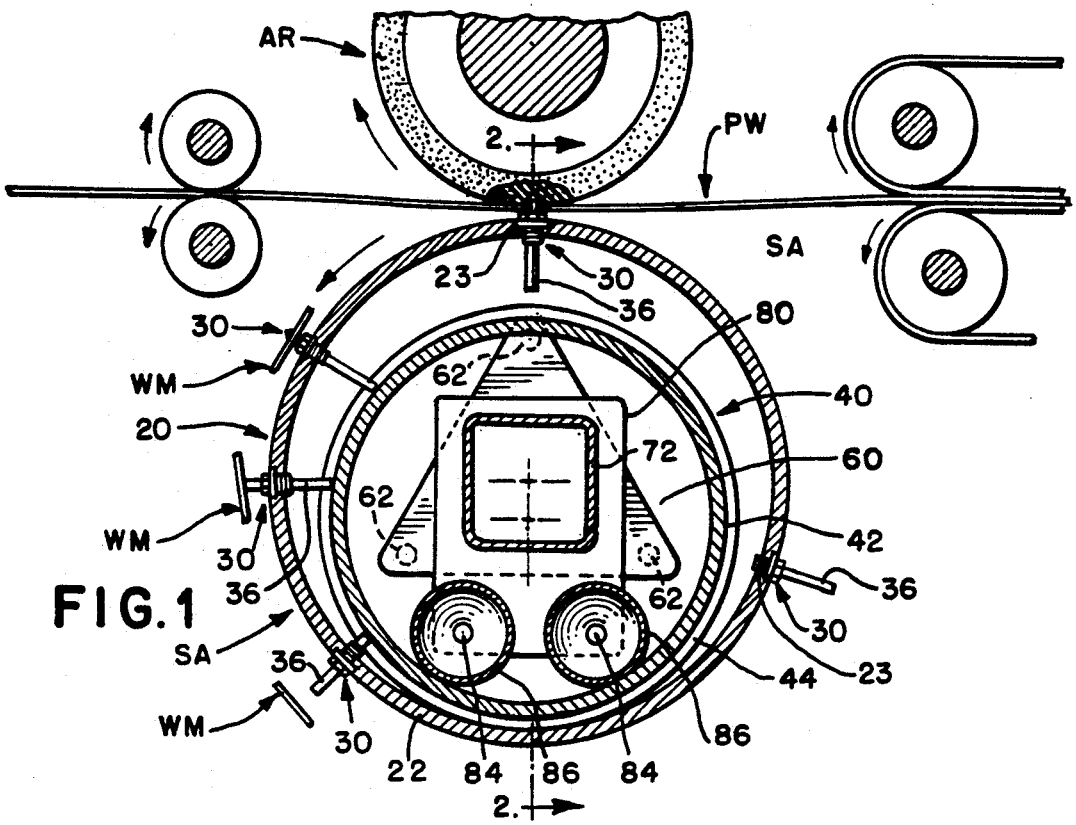
FIG. 1 is a fragmentary side view, partly in vertical cross section, of the die cutting section of a press illustrating a paperboard stripping apparatus embodying features of the invention.

Referring now to the drawings for a better understanding of the invention, as best seen in FIG. 1, the invention relates to a paperboard stripping apparatus, indicated generally at SA, which, in cooperation with an anvil roll AR, is used for stripping waste material WM from a pre-cut paperboard web PW in a die cutter or die cutting section of a press.

The die cutter or press, which is not shown in detail, has a frame 10 that includes a pair of transversely spaced, vertically extending side plates; the plate on the drive or inboard side being designated 12, and the plate on the operator or outboard side being designated 14.

The stripper apparatus SA includes an outer or pin cylinder 20 having a hollow, tubular, sleeve-like body 22 through which extends a plurality of threaded openings 23 adapted to receive stripper pin mechanisms indicated generally at 30.

Figure 2:
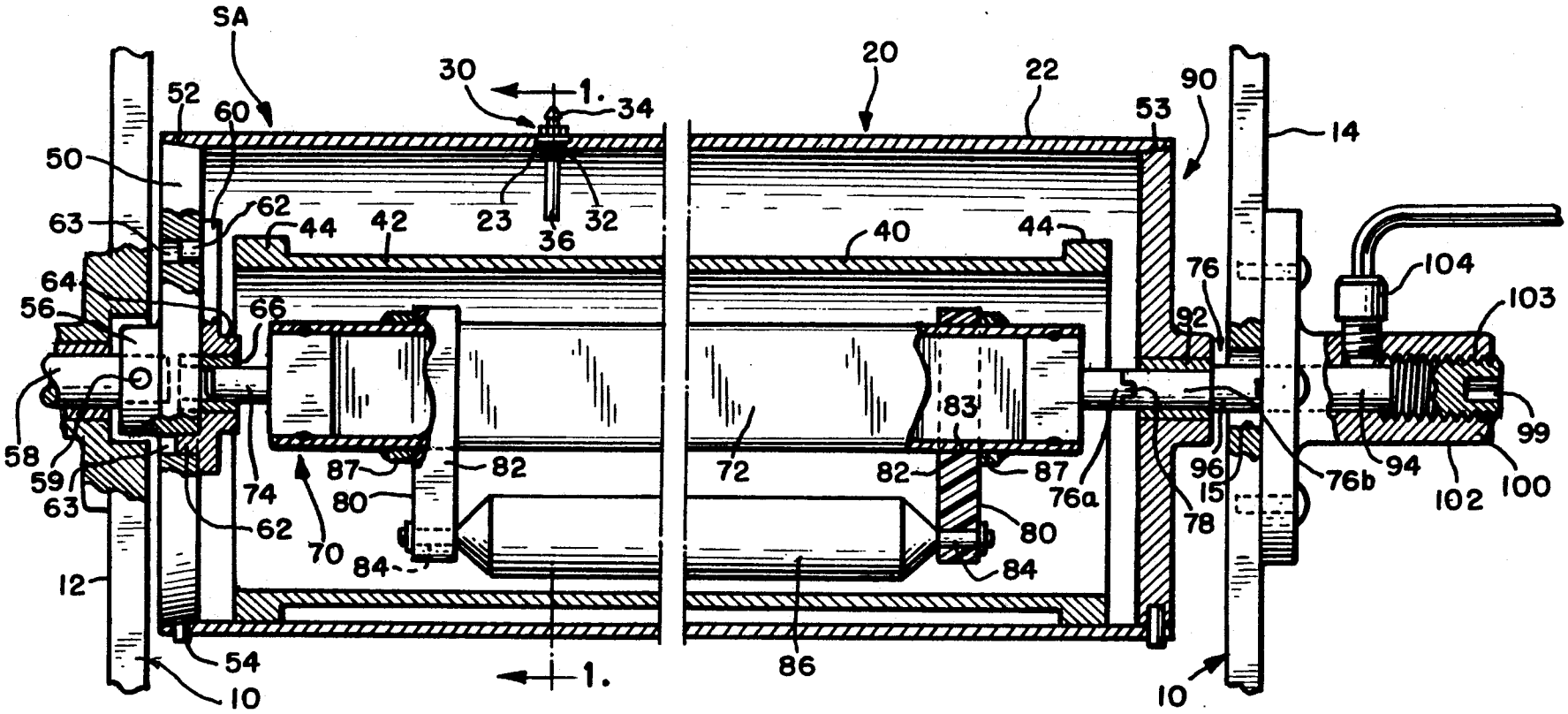
FIG. 2 is a fragmentary vertical sectional view, taken on line 2—2 of FIG. 1 and with portions of the structure broken away, illustrating both the inboard or drive side of the structure and the outboard or operator side of the structure.

As best seen in FIGS. 1 and 2, outer pin cylinder 20 also includes a pair of circular, inboard and outboard end plates 50 and 90, which are snugly fitted into the inboard and outboard ends, respectively, of the pin cylinder body 22.

In order to insure a tight fit, body 22 may be tapered at its inboard and outboard ends, as indicated at 52 and 53, respectively. Also, inner end plate 50 may be secured to the body by one or more pins or screws 54.

Inboard end plate 50 has, on the inboard side thereof, an integral hub 56 adapted to receive the outboard end of a drive shaft 58 carried by the frame 10. The end plate hub 56 may be secured to the drive shaft 58 by a pin or screw 59.

Figure 3:
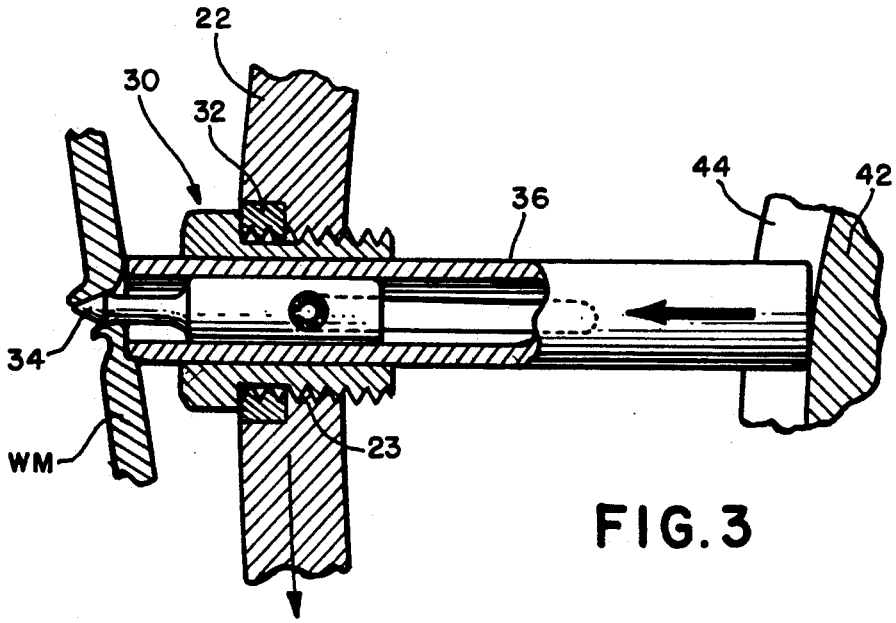
FIG. 3 is an enlarged view of a portion of the structure illustrated in FIG. 1 that shows one of the pin stripping mechanisms.

As best seen in FIG. 3, each stripper mechanism includes a bushing 32, threadably mounted in a related opening 23 in the pin cylinder and which contains a stripper pin 34 projecting out of the bushing for contact with the paperboard web. The stripper mechanism also includes an ejector sleeve 36, positioned in the bushing over the stripper pin, and mounted for sliding movement axially between a retracted position, where the pin is exposed, and an extended position, where the sleeve covers the outer tip of the stripper pin to force waste material off the pin.

The movement of the sleeves 36 out of the bushings in the pin cylinder from the retracted position to the extended or ejecting position is effected by an inner ejection cylinder 40 which is mounted eccentrically within the outer pin cylinder 20 for engagement with the ejector sleeves as the pin cylinder rotates.

The ejection cylinder 40 comprises a hollow tubular body 42 with integral annular rims 44 at each end thereof which extend radially outward from the outer surface of the body. The rims serve to reinforce the body and also to space the outer surface of the body a sufficient distance from the inner surface of the outer pin cylinder 20 to allow the inner ends of the bushings 32 to clear the body 42 of the ejection cylinder 40 as the pin cylinder 20 rotates around the ejection cylinder.

An extremely important feature of the present invention is the improved inner cylinder mounting arrangement 70, which is simpler and less expensive than comparable arrangements for mounting one cylinder eccentrically within another.

As best seen in FIG. 2, a mounting plate 60 is positioned against and detachably secured to the outboard side of inboard end plate 50. Although mounting plate 60 illustrated in the drawings is shown as being triangular, no specific shape is required.

By using the mounting plate, as hereinafter described, it is possible to convert a press by replacing a standard pin cylinder having conventional pins that require a bar comb to clear the pins with a pin cylinder having self cleaning pins with ejector sleeves that do not need a bar comb and are actuated by an inner cylinder.

Mounting plate 60 has, extending inboardly from its inboard side, a plurality of integral mounting pins 62 adapted to be received within complementary holes 63 in the outboard side of inboard end plate 50. When it is desired to remove the mounting, the mounting plate can be easily pulled from the end plate.

Plate 60 has, on its outboard side, an integral hub 64 with a bearing 66 adapted to rotatably receive a cylindrical stub shaft 74 extending inboardly from the inboard end of a square mounting arm or beam 72. Another cylindrical shaft 76 extends outboardly from the outboard end of beam 72. Stub shaft 76 includes two coaxial sections 76*a*, the inboard section, and 76*b*, the outboard section, which are detachably joined by tongue and groove connection 78 to accommodate removal and replacement of the cylinders.

As hereinafter described, the purpose of mounting beam shafts 74 and 76 is to allow the square mounting beam 72 to be journaled with respect to the outer pin cylinder end plates 50 and 90, so the end plates and attached outer pin cylinder body are free to rotate about the axis of the drive shaft 58, while the mounting beam 72 remains stationary in a fixed position.

As best seen in FIGS. 1 and 2, the inner ejection cylinder 40 is maintained in an eccentric position, within outer pin cylinder 20 and adjacent the lowermost inner surface of the outer cylinder, by a pair of trolleys 80 suspended from mounting beam 72.

Each of the trolleys 80 includes a flat plate 82 having, at the upper end thereof, a square hole 83 extending therethrough for receipt of the square mounting beam 72, as best seen in FIG. 1. At their lower ends trolley plates 82 carry a pair of shafts or axles 84 on which are rotatably mounted a pair of rollers 86.

The rollers 86 are engagably with the inner surface of ejection cylinder 40 to hold it in a predetermined position against the inner surface of outer pin cylinder 20.

In order to prevent the trolley plates from moving axially on the mounting beam 72, the beam may be provided with shoulders or other stop means 87 located adjacent the trolley plates.

As best seen at the right of FIG. 2, pin cylinder outboard end plate 90 contains a central bore with a bearing 92 and is rotatably mounted on mounting beam shaft section 76*b*. At its inboard end shaft section 76*b* is detachably joined to the outboard end of shaft section 76*a* by the detachable tongue and groove connection 78 which is located inboardly of outboard end plate 90.

Shaft section 76*b* also has a shoulder or stop 96 engagable with outboard end plate 90 to prevent plate 90 from moving out of the pin cylinder body after it has been positioned in place within the pin cylinder body as described hereinafter.

The outboard end of shaft section 76*b* is disposed to extend through an opening 15 in outboard frame wall 14. A housing 100 mounted on the outboard side of frame wall 14 contains a hub 102 with a threaded bore 103 which is adapted to threadably receive the threaded outboard end of shaft section 76*b*.

In order to assemble the apparatus, either as a completely new installation, or as a conversion of a conventional press, the first step is to place the mounting plate 60 against the outboard side of the pin cylinder inboard end plate 50, which is already in position and mounted on drive shaft 58, with the pins 62 of the mounting plate inserted into the holes 63 of the end plate 50.

The outboard end of shaft section 76*b* may be provided with an opening 99 for receiving an Allen wrench or other type tool, so that, after the outer and inner cylinders and the mounting beam and trolleys have been placed in position, the outboard end plate 90 can then be forced into the outboard end of the pin cylinder body 22 by rotating the shaft section 76*b* with a tool to move the shaft inboardly until its inboard end engages the outboard end of mounting beam shaft section 76*a*.

The engagement between shoulder 96 of shaft section 76*b* and the outboard end plate 90 will force the end plate into the end of the pin cylinder body and thereafter keep it there. After the end plate is in place the shaft section 76*b* can then be locked in position by a set screw 104 extending through housing hub 102.

After the apparatus has been assembled, its operation is similar to other stripping equipment that has self cleaning pins with ejector sleeves. As the pin cylinder rotates, the pins engage the paperboard web, at a location between the pin cylinder and anvil roll, and pierce the waste material to be removed. After the pin cylinder has rotated further, the waste material is forced off the pins by the outward movement of the ejector sleeves which are moved to the extended or ejection position by the inner ejection cylinder as previously described.

What is claimed is:

1. Apparatus for stripping waste material from a paperboard web that has been cut to define at least one blank, comprising:

(a) a frame having a pair of opposed, vertically extending, inboard and outboard side walls spaced transversely from each other;

(b) an outer pin cylinder secured to a drive shaft carried by said frame adjacent an inboard side wall of said frame and supported between said side walls for rotation about a horizontal axis;

(c) said pin cylinder including a hollow tubular body and a pair of detachable, circular, inboard and outboard end plates, each of said end plates including journal bearing means;

(d) an anvil roll mounted adjacent said pin cylinder for rotation about an axis parallel to said pin cylinder axis;

(e) means for passing a precut web of paperboard between said pin cylinder and anvil roll;

(f) said pin cylinder body having a plurality of threaded openings extending therethrough;

(g) stripper pin mechanisms mounted in certain of said pin cylinder body openings, each of said stripper mechanisms including:

(i) a threaded bushing having a stripper pin that projects outwardly from said bushing beyond an outer surface of said pin cylinder for contact with said paperboard web to push waste material out of the plane of said web;

(ii) an ejector sleeve positioned in said bushing and mounted over said pin for axial movement between a retracted position, where said pin is exposed for contact with said web, and an extended position, where waste material is forced off said pin;

(h) an inner ejection cylinder mounted eccentrically within said outer pin cylinder for engagement with said ejector sleeves, when the latter are in predetermined locations, to move said sleeves from a retracted position to an extended position and thereby force waste material off related stripper pins;

(i) means for detachably mounting said ejection cylinder eccentrically within said pin cylinder, comprising:

(i) an elongated, stationary mounting beam, rectilinear in cross section, positioned within said ejection cylinder and having, extending from opposite ends thereof, shaft means supported in said end plate journal bearing means to accommodate relative rotational movement between said pin cylinder and said mounting beam;

(ii) a pair of trolleys non-rotatably secured to and depending from said mounting beam;

(iii) said trolleys carrying, at lower ends thereof, roller means engagably with an inside surface of said ejection cylinder and operable to maintain said ejection cylinder in a predetermined position in contact with said pin cylinder whereby, when said ejection cylinder engages said ejector sleeves, the sleeves are moved radially outward to force waste material from said stripper pins.

2. Apparatus for stripping waste material from a paperboard web that has been cut to define at least one blank, comprising:

(a) a frame having a pair of opposed, vertically extending, inboard and outboard side walls spaced transversely from each other;

(b) an outer pin cylinder secured to a drive shaft carried by said frame adjacent an inboard side wall of said frame and supported between said side walls for rotation about a horizontal axis;

(c) said pin cylinder including a hollow tubular body and a pair of detachable, circular, inboard and outboard end plates, each of said end plates including journal bearing means;

(d) an anvil roll mounted, adjacent said pin cylinder for rotation about an axis parallel to said pin cylinder axis;

(e) means for passing a precut web of paperboard between said pin cylinder and anvil roll;

(f ) said pin cylinder body having a plurality of threaded openings extending therethrough;

(g) stripper pin mechanisms mounted in certain of said pin cylinder body openings, each of said stripper mechanisms including:

(i) a threaded bushing having a stripper pin that projects outwardly from said bushing beyond an outer surface of said pin cylinder for contact with said paperboard web to push waste material out of the plane of said web;

(ii) an ejector sleeve positioned in said bushing and mounted over said pin for axial movement between a retracted position, where said pin is exposed for contact with said web, and an extended position, where waste material is forced off said pin;

(h) an inner ejection cylinder mounted eccentrically within said outer pin cylinder for engagement with said ejector sleeves, when the latter are in predetermined locations, to move said sleeves from a retracted position to an extended position and thereby force waste material off related stripper pins;

(i) means for detachably mounting said ejection cylinder eccentrically within said pin cylinder, comprising:

(i) an elongated, stationary mounting beam positioned within said ejection cylinder and having, extending from opposite ends thereof, shaft means supported in said end plate journal bearing means to accommodate relative rotational movement between said pin cylinder and said mounting beam;

(ii) a pair of ejection cylinder positioning members secured to and depending from said mounting beam;

(iii) said positioning members carrying, at lower ends thereof, roller means engagably with an inside surface of said ejection cylinder and operable to maintain said ejection cylinder in a predetermined position in contact with said pin cylinder whereby, when said ejection cylinder engages said ejector sleeves, the sleeves are moved radially outward to force waste material from said stripper pins.

3. Apparatus for stripping waste material from a paperboard web that has been cut to define at least one blank, comprising:

(a) a frame;

(b) an outer pin cylinder secured to a drive shaft carried by said frame and supported thereby for rotation about a horizontal axis;

(c) said pin cylinder including a hollow tubular body and a pair of detachable, circular, inboard and outboard end plates, each of said end plates including journal bearing means;

(d) said pin cylinder body having a plurality of threaded openings extending therethrough;

(e) stripper pin mechanisms mounted in certain of said pin cylinder body openings, each of said stripper mechanisms including:

(i) a threaded bushing having a stripper pin that projects outwardly from said bushing beyond an outer surface of said pin cylinder for contact with said paperboard web to push waste material out of the plane of said web;

(ii) an ejector sleeve positioned in said bushing and mounted over said pin for axial movement between a retracted position, where said pin is exposed for contact with said web, and an extended position, where waste material is forced off said pin;

(f) an inner ejection cylinder mounted eccentrically within said outer pin cylinder for engagement with said ejector sleeves, when the latter are in predetermined locations, to move said sleeves from a retracted position to an extended position and thereby force waste material off related stripper pins;

(g) means for detachably mounting said ejection cylinder eccentrically within said pin cylinder, comprising:

(i) an elongated, stationary mounting beam positioned within said ejection cylinder and having, extending from opposite ends thereof, shaft means supported in said end plate journal bearing means to accommodate relative rotational movement between said pin cylinder and said mounting beam;

(ii) at least one cylinder positioning member secured to and depending from said mounting beam;

(iii) said positioning member carrying, at its lower end, means engagably with an inside surface of said ejection cylinder and operable to maintain said ejection cylinder in a predetermined position in contact with said pin cylinder whereby, when said ejection cylinder engages said ejector sleeves, the sleeves are moved radially outward to force waste material from said stripper pins.

4. Apparatus according to claim 1, wherein the journal bearing means of said pin cylinder inboard end plate is carried by a separate mounting plate detachably secured to the outboard side of said pin cylinder end plate.

5. Apparatus according to claim 2, wherein the journal bearing means of said pin cylinder inboard end plate is carried by a separate mounting plate detachably secured to the outboard side of said pin cylinder end plate.

6. Apparatus according to claim 3, wherein the journal bearing means of said pin cylinder inboard end plate is carried by a separate mounting plate detachably secured to the outboard side of said pin cylinder end plate.

7. Apparatus according to claim 4, wherein said mounting plate has, on the inboard side thereof, a plurality of integral pins adapted to be received in complementary openings in the outboard side of said pin cylinder inboard end plate, and wherein said mounting plate has, on the outboard side thereof, an integral hub housing said journal bearing means.

8. Apparatus according to claim 5, wherein said mounting plate has, on the inboard side thereof, a plurality of integral pins adapted to be received in complementary openings in the outboard side of said pin cylinder inboard end plate, and wherein said mounting plate has, on the outboard side thereof, an integral hub housing said journal bearing means.

9. Apparatus according to claim 6, wherein said mounting plate has, on the inboard side thereof, a plurality of integral pins adapted to be received in complementary openings in the outboard side of said pin cylinder inboard end plate, and wherein said mounting plate has, on the outboard side thereof, an integral hub housing said journal bearing means.

10. Apparatus according to claim 1, wherein the shaft means extending from the inboard end of said mounting beam comprises a single stub shaft, and the shaft means extending from the outboard end of said mounting beam comprises a pair of detachably interconnected, coaxial, inboard and outboard shaft sections.

11. Apparatus according to claim 2, wherein the shaft means extending from the inboard end of said mounting beam comprises a single stub shaft, and the shaft means extending from the outboard end of said mounting beam comprises a pair of detachably interconnected, coaxial, inboard and outboard shaft sections.

12. Apparatus according to claim 3, wherein the shaft means extending from the inboard end of said mounting beam comprises a single stub shaft, and the shaft means extending from the outboard end of said mounting beam comprises a pair of detachably interconnected, coaxial, inboard and outboard shaft sections.

13. Apparatus according to claim 10, wherein said outboard shaft section has a first portion journaled in said pin cylinder outboard end plate and a second portion mounted in said frame for axial movement of said outboard shaft section away from said inboard shaft section to accommodate removal of said cylinders.

14. Apparatus according to claim 11, wherein said outboard shaft section has a first portion journaled in said pin cylinder outboard end plate and a second portion mounted in said frame for axial movement of said outboard shaft section away from said inboard shaft section to accommodate removal of said cylinders.

15. Apparatus according to claim 12, wherein said outboard shaft section has a first portion journaled in said pin cylinder outboard end plate and a second portion mounted in said frame for axial movement of said outboard shaft section away from said inboard shaft section to accommodate removal of said cylinders.

16. Apparatus according to claim 2, wherein said positioning members comprise a pair of trolleys spaced from each other on said mounting beard, and including means on said mounting beam to maintain said trolleys in predetermined positions.

17. Apparatus according to claim 3, wherein said positioning member comprises a trolley and wherein said means carried at the lower end of said positioning member comprises roller means.

18. Apparatus according to claim 1, wherein said trolleys each comprise a vertically disposed plate having adjacent, its upper end, an opening extending therethrough for receiving said mounting beam.

19. Apparatus according to claim 16, wherein said trolleys each comprise a vertically disposed plate having adjacent, its upper end, an opening extending therethrough for receiving said mounting beam.

20. Apparatus according to claim 17, wherein said trolley comprises a vertically disposed plate having adjacent, its upper end, an opening extending therethrough for receiving said mounting beam.

* * * * *